US005425576A

United States Patent [19]

Yee et al.

[11] Patent Number: 5,425,576

[45] Date of Patent: Jun. 20, 1995

[54] DISPLAY AND DISPENSOR UNIT FOR PARTICULATE PRODUCTS

[75] Inventors: Jack T. C. Yee; Brenda A. Jones; Sharon K. Bruce, all of Calgary, Canada

[73] Assignee: Tin Soldier Inc, Calgary, Canada

[21] Appl. No.: 151,833

[22] Filed: Nov. 15, 1993

[30] Foreign Application Priority Data

Nov. 12, 1993 [CA] Canada ..... 2103005

[51] Int. Cl.[6] ..... A47F 3/10

[52] U.S. Cl. ..... 312/125; 312/139.1; 312/305

[58] Field of Search ..... 312/125, 135, 295, 324, 312/126, 139.1, 305; 211/131

[56] References Cited

U.S. PATENT DOCUMENTS

| | | | |
|---|---|---|---|
| 855,951 | 6/1907 | Hull | 312/305 |
| 1,359,668 | 11/1920 | Buchenau | 312/125 |
| 1,559,705 | 11/1925 | Jackiou | 312/305 |
| 1,829,995 | 11/1931 | Lingberger | 312/125 |
| 2,138,190 | 11/1938 | Myers | 312/305 |
| 2,832,659 | 4/1958 | Akers | 312/295 |
| 3,948,416 | 4/1976 | Housman | 221/121 |

FOREIGN PATENT DOCUMENTS

| | | |
|---|---|---|
| 272819 | 8/1927 | Canada . |
| 740304 | 8/1966 | Canada . |
| 869385 | 4/1971 | Canada . |
| 1022509 | 12/1977 | Canada . |
| 1134330 | 10/1982 | Canada . |

*Primary Examiner*—Kenneth J. Dorner
*Assistant Examiner*—Gerald A. Anderson

[57] ABSTRACT

A display and dispenser device for piece goods, particularly candy and dried foodstuffs such as peas or beans. The device includes a number of containers for the goods, each having an enclosing container wall including a transparent front wall provided with an access opening and a movable door closing the opening. The containers are arranged around a generally horizontal axis to form a display unit. The device also includes a support for the display unit permitting rotation of the unit about the central axis. An arrangement is also provided to prevent opening of the doors on each of the containers, except for the doors on one or more containers in predetermined dispensing station around the axis. The contents of the containers are visible to the customer and display unit can be rotated about the axis to position a desired container in the dispensing station where the container door can be opened and the contents removed. As the display unit is rotated, the contents of the containers tumble about the interiors of the containers and present a noticeable visual display and a rattling sound that attracts attention and interest among potential customers.

11 Claims, 5 Drawing Sheets

DISPLAY AND DISPENSOR UNIT FOR PARTICULATE PRODUCTS

BACKGROUND OF THE INVENTION

1. FIELD OF THE INVENTION

This invention relates to display and dispenser units for particulate products such as candy and dried foodstuffs.

2. DESCRIPTION OF THE PRIOR ART

It is becoming quite commonplace these days for shops and stores to buy piece goods, such as wrapped candy and dried foodstuffs (e.g. peas, beans, etc.) in bulk and to display them in open containers so that customers may select and bag the products for themselves. The containers used for this purpose are often paperboard barrels or the like having open tops, often closed off by clear plastic lids that allow the products to be seen and selected but also provide a degree of hygiene.

The problem with this sort of arrangement is that the products are not very visible to the customers and the containers are not very attractive, and this often translates into reduced sales.

It has of course been known for a very long time to display attractive piece goods, such as coloured or wrapped candies, in clear walled containers, such as large glass jars or clear plastic boxes. The attractiveness of the goods themselves interests the customers. However, such containers, for maximum effect, should be placed at or about eye level, and this requires considerable shelf space and may create access difficulties for the customers if the containers are positioned too high.

There is therefore a need for improved display and dispensing units for particulate goods, such as candies and dried foods, etc., that provide a clear and attractive display of the goods, but also allow good access and a good degree of hygiene.

SUMMARY OF THE INVENTION

An object of the invention is to facilitate the display and dispensing of piece goods, such as candies and dried food items.

Another object of the invention is to make it possible to provide a selection of such goods while allowing good access by customers to all of the different types of goods forming the selection.

Another object of the invention is to provide a movable display for a selection of such goods, while avoiding unwanted spilling of the goods from the display.

According to one aspect of the invention, there is provided a display and dispenser device for piece goods, comprising a plurality of containers for said goods, each container having a container wall including a generally transparent front wall provided with an access opening and a movable door closing said opening, said containers being arranged around a generally horizontal axis to form a display unit, a support for said display unit permitting rotation of said unit about said axis, and means to prevent opening of said door on each of said containers, except for said door on one or more containers in a predetermined position around said axis.

The device provides an attractive display for the piece goods which are visible through the transparent front walls of the individual containers and allows easy access to any of the containers by permitting rotation of the display unit around the horizontal axis until a particular container containing piece goods desired by the customer is moved to a position (i.e. a dispensing station) where access is easy, usually at the lowermost point of the display unit. The doors closing the individual containers are unopenable except for the container(s) positioned at the dispensing station, so that other containers cannot be opened inadvertently, thereby avoiding possible spilling of the piece goods from the containers.

DETAILED DESCRIPTION OF THE PREFERRED EMBODIMENT

Figure 1:
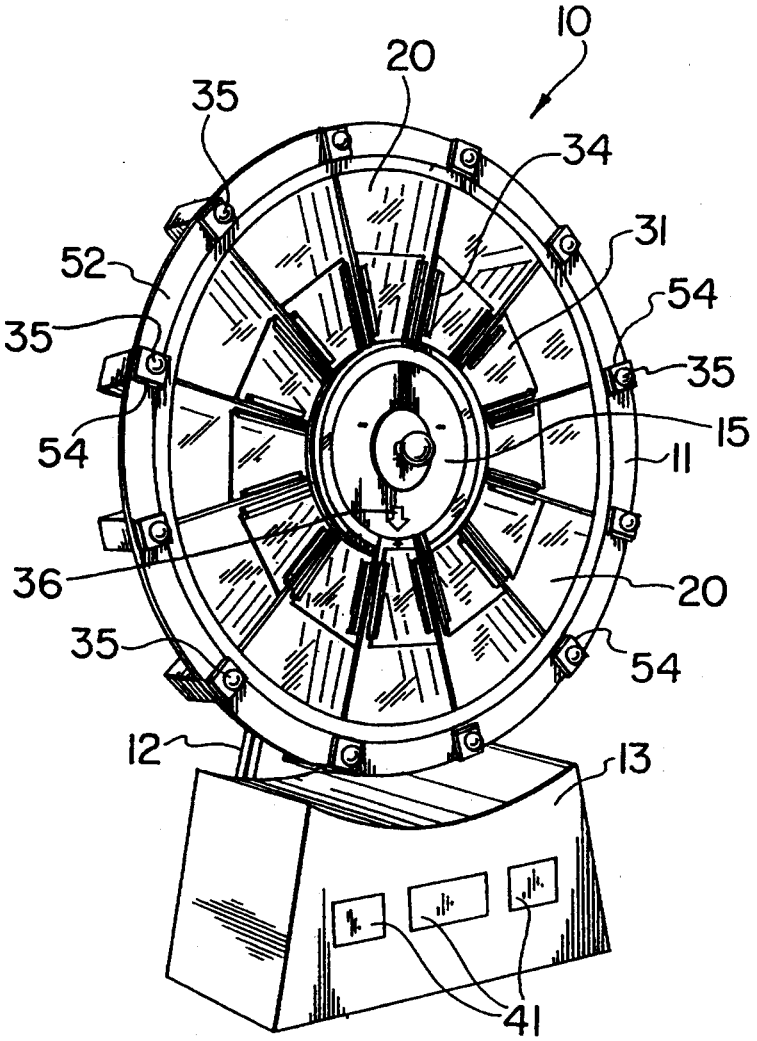
FIG. 1 is a perspective view of a preferred display and dispensing device according to the present invention.
Figure 2:
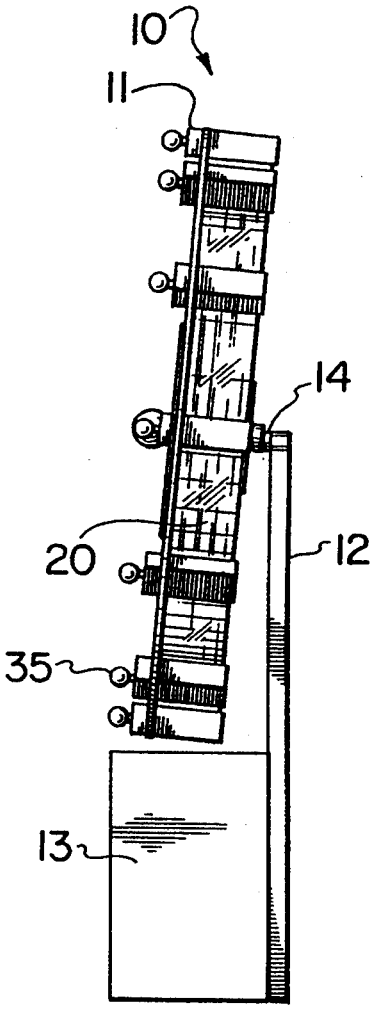
FIG. 2 is a side elevational view of the device of FIG. 1.
Figure 3:
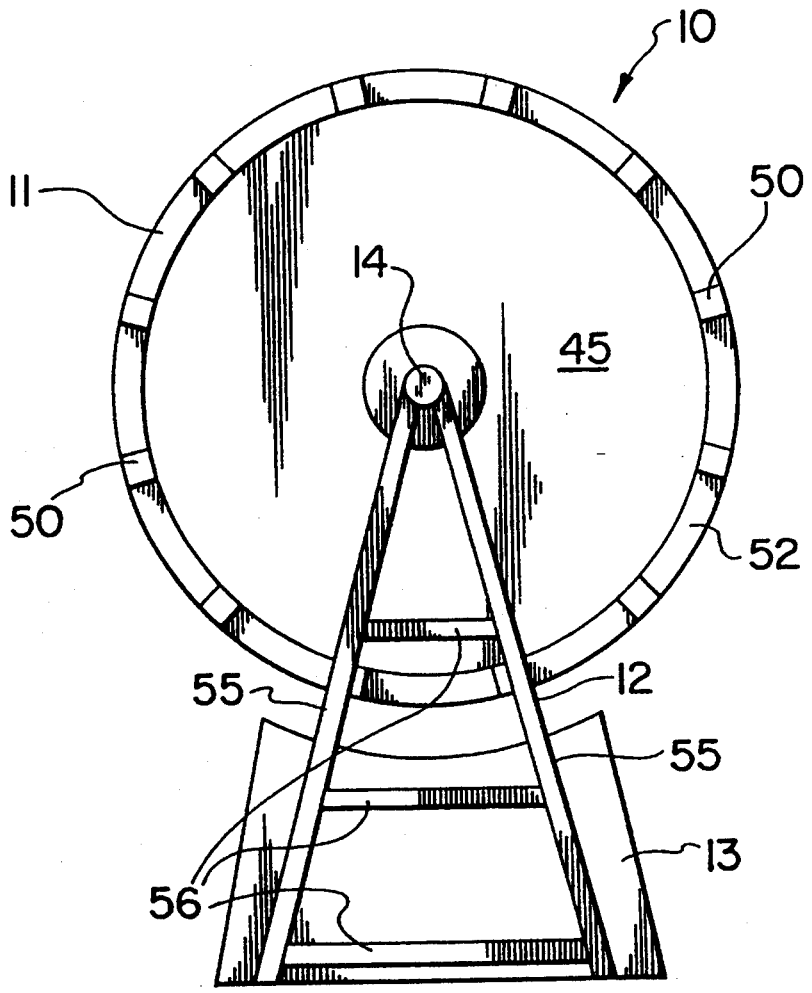
FIG. 3 is a rear elevational view of the device of FIGS. 1 and 2.

A preferred display and dispenser device according to the present invention is shown in the accompanying drawings. The device 10 has a circular display unit 11 mounted on a support 12 provided with an enlarged base 13. The support 12 carries a generally horizontal axle 14 (which may be made of or coated with polytetrafluoroethylene to eliminate the need for lubrication) on which the display unit 11 is rotatably mounted. In actual fact, while the axle is generally horizontal, as stated, it is preferably angled slightly upwardly from the horizontal towards the front of the device, as can be seen most clearly in FIG. 2, for a reason that will be explained later. The axle 14 also supports an enlarged circular plate 15 at the front of the device 10, which plate does not form part of the display unit 11 and does not rotate.

The display unit 11 is made up of a number of hollow containers 20, each being generally in the shape of a truncated triangular prism, arranged side-by-side around the central axle 14, thus forming individual segments of the circular display unit 11. One of the containers is shown in isolation in perspective view in FIG. 4. Each of the containers has front and rear walls 21 and 22, respectively, as well as outer peripheral edge walls 23, radial side edge walls 24 and inner peripheral edge walls 25. Preferably, all of these walls are made of a transparent material, e.g. clear plastics such as transparent sheet acrylic.

The front wall 21 of each container has an access opening 30, usually positioned closer to the narrow end of the container than the broad end, closable by a movable door 31. As shown, each door 31 is outwardly pivotable about a hinge 32, e.g. a piano hinge or an adhered flexible strip, along one lateral edge and is kept in the closed position by means of a simple catch, e.g. a magnetic catch (not shown), at the opposite lateral edge. A finger pull 34 or other gripping element may by provided on each door to facilitate opening and closing of the door, when required.

The doors 31 are preferably transparent so that the contents of the containers 20 may be seen clearly through the front walls 21, i.e. both through the fixed parts of the front walls and through the openable doors 31. In fact the same material can be used for both parts of the front walls 21.

The display unit 11 can be rotated freely around axle 14 by the customer and handles 35 are provided at regular intervals around the periphery of the circular display unit to facilitate this. By this means, a container enclosing a desired product can be brought to the lowermost position of the display unit which acts as a dispensing station. In this position, the container can easily be reached by the customer, since it is at about waist height, and the particulate product is not likely to spill out of the container when the door 31 is opened because the access opening 30 is in the uppermost part of the front wall 21. Moreover, the slight upward angle of the axle 14 tends to slope the upper surface of the particulate product away from the door towards the rear wall 22 of the container in this lowermost position. The customer can therefore open the door 31, remove an appropriate amount of the particulate product and close the door 31.

In the case of the containers 20 that are not in the lowermost dispensing position around the display unit 11, inadvertent opening of the doors 31 could result in unwanted spilling of the particulate contents from the containers. To prevent this, the outer edge of the central circular plate 15 extends over and in front of the innermost edges of the doors 31 in the case of all the containers except for the one in the dispensing (lowermost) station, thus preventing inadvertent opening of the doors. This prevents improper use of the device or accidental opening of the doors as the circular display unit 11 is rotated.

Figure 5:
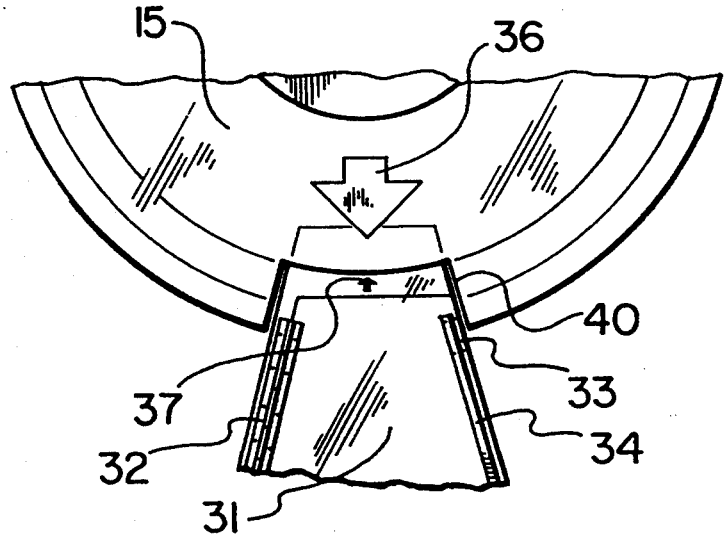
FIG. 5 is an enlarged partial view of the innermost end of a container of the device of FIGS. 1 to 3 when in the dispensing position.

As shown in greater detail in FIG. 5, an inward recess 40 in the periphery of the central circular plate 15 at the lowermost position makes it possible for the door 31 of the container 30 in this position to be opened because the movement of the door is not blocked by the plate 15. However, if the customer forgets to close the door 31, or closes it insecurely, the non-recessed part of the outer edge of the circular plate 15 acts to close the door as the display unit 11 is rotated by virtue of its engagement with the innermost end of the unclosed door 31 as the display unit rotates, at least in the clockwise direction. If the display unit were to be rotated in the anti-clockwise direction, an open door 31 would quickly wedge against the outer edge of the circular plate 15 and would thus prevent further rotation.

The central circular plate 15 desirably has an indication, such as an enlarged arrow 36, clearly marked in order to indicate to the customer that the display unit 11 should be rotated until the container of choice is positioned in the indicated dispensing station. Each container preferably has a small central arrow 37 on its front face adjacent to the narrow end to indicate proper positioning of the container in the dispensing station when the large and small arrows 36 and 37 are aligned. The plate 15 obscures the arrows 37 on all the containers except for the one positioned in the dispensing station.

If desired, utensils such as scoops (not shown) may be supported by hooks on the central circular plate 15 to assist with the removal of the particulate products from the containers through the access openings 30. Moreover, also if desired, the base 13 may be provided with drawers 41 for storing bags or boxes of various sizes to receive the particulate products removed from the containers 20.

As the display unit 11 is rotated around axle 14 by a customer desiring a product contained in one of the containers not already located at the dispensing position, the particulate products contained within the containers 20 tumble around the inside of their respective containers and make a noticeable visible display and a rattling noise that attracts the attention and interest of other customers in the establishment where the device is installed, thus increasing the potential for further sales.

Having described the preferred display and dispenser device of the present invention and its operation in general terms, more detailed information about the construction of the device is described in the following passages.

Figure 4:
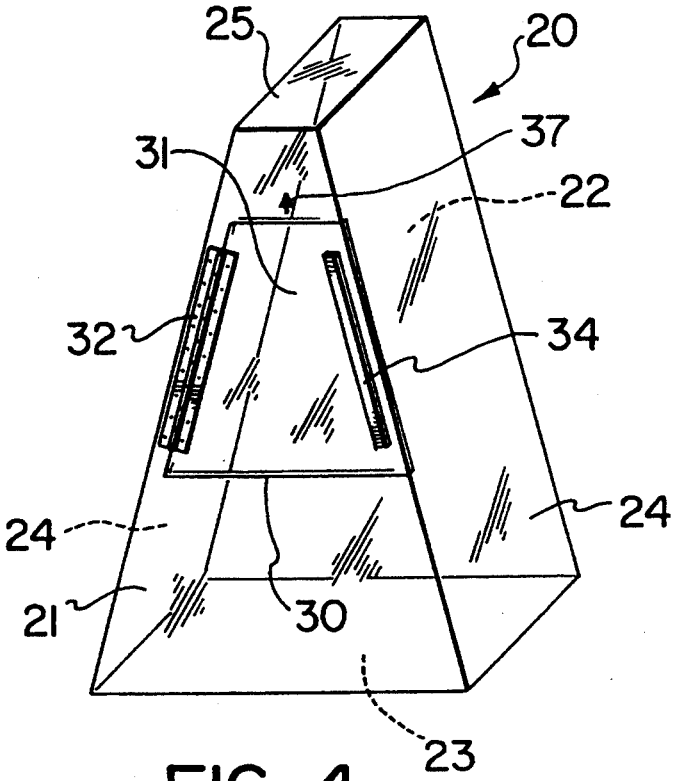
FIG. 4 is a perspective view of one of the several containers in the device of FIGS. 1 to 3.

While the containers 20 may merely be compartments forming integral parts of a single circular display unit produced by injection moulding or the like, or alternatively may be individual elements joined together by bonding or by means of mechanical fasteners, they are more preferably separate elements, as shown in FIG. 4, that are simply held adjacent to each other by other elements of the circular display unit.

Figure 6:
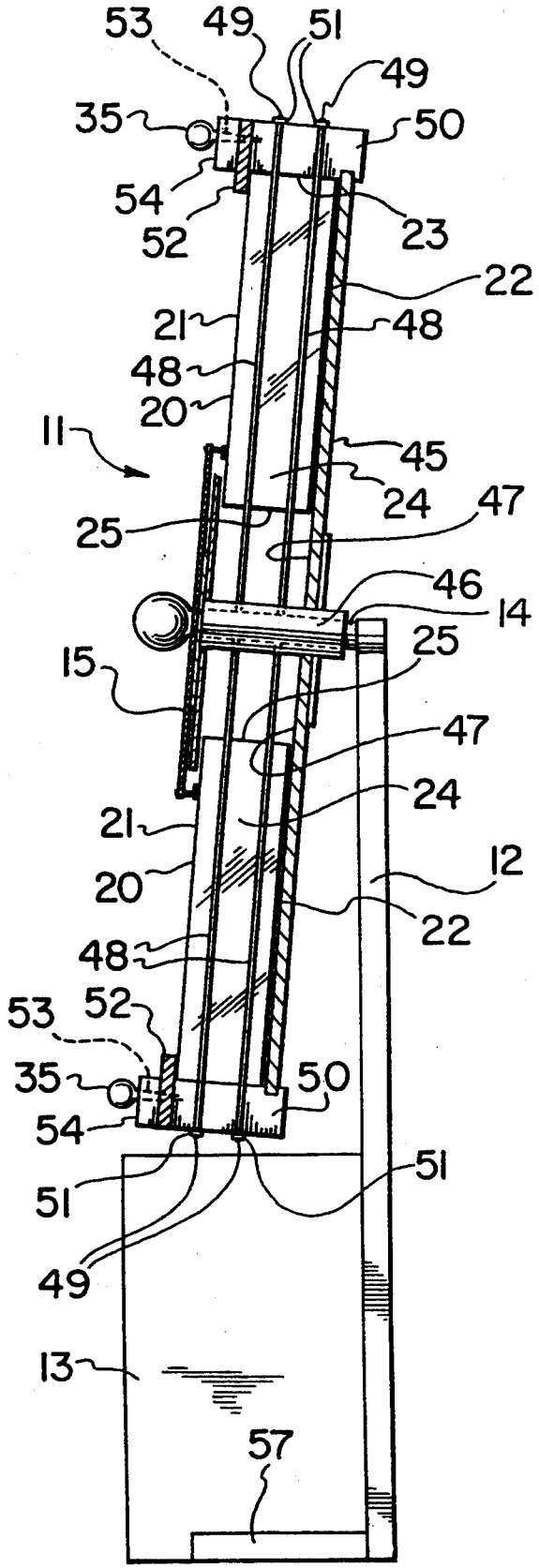
FIG. 6 is a vertical cross-sectional view of the device of FIG. 1 to 3.

This manner of construction is achieved by providing a large circular backing plate 45 having an integral forwardly projecting central circular hub 46 centrally penetrated to seat and rotate upon axle 14 (see in particular FIG. 6). The inner surface 47 of the circular backing plate is preferably reflective, e.g. covered with a metallized plastic film, so that it reflects light and thus makes the contents of the containers more visible and attractively presented when the display unit 11 is viewed from the front.

The forward end of the axle 14 carries the central circular plate 15 which retains the hub 46 in position on the axle 14. The hub 46 anchors inner ends of elongated metal spokes 48 arranged in pairs around the periphery of the hub and extending to the periphery of the circular backing plate 45. The outer ends 49 of the metal spokes 48 pass through bores extending through anchor blocks 50 positioned at regular intervals around, and removably seated on, the periphery of the circular backing plate 45, and are fastened to the blocks 50 by nuts 51 fitted onto threads cut into the spokes. The anchor blocks 50 in turn support an outer retaining ring 52 which may be attached to the blocks by means of threaded spikes 53 projecting inwardly from handles 35 and passing completely through decorative blocks 54 and the retaining ring into the anchor blocks 50.

The containers 20 are positioned within the display unit 11 between adjacent sets of the spokes 48 and they are retained in place by abutment with the following elements: the anchor blocks 50, which contact the outer edge walls 23 of the containers; the sets of spokes, which contact the radial side walls 24 of the containers; the circular backing plate 45, which contacts the rear walls 23 of the containers; the retaining ring 52, which contacts the outer edges of the front walls 21 of the containers; and the central circular plate 15 which contacts (albeit slidably) the inner edges of the front walls of the containers. If desired, felt pads or a felt ring may be positioned between the central plate 15 around its periphery and the adjacent parts of the containers to reduce friction as the display unit moves beneath the central plate 15. Inner edge walls 25 do not necessarily contact the outer periphery of the hub 26 and are usually separated from it by a considerable distance, as shown.

The arrangement of the elements of the circular display unit 11 as described above makes it possible to remove individual containers 20 from the unit, if desired, e.g. for repair. This can be done by removing adjacent retaining anchor blocks 50 and sliding out a container in the radial direction. The anchor blocks 50 can be removed by unscrewing nuts 51 and handles 35 and withdrawing the blocks from the outer edge of the circular backing plate 45.

Figure 7:
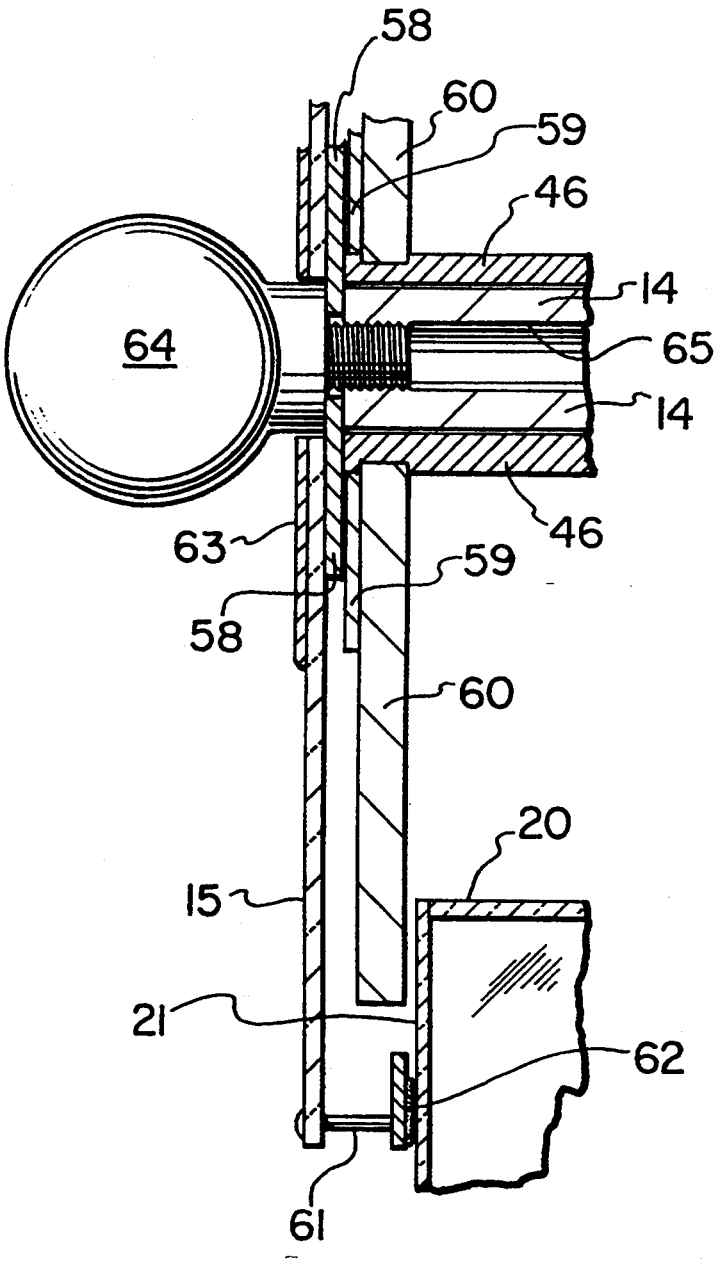
FIG. 7 is an enlarged partial cross-sectional view of the central region of the device of FIGS. 1 to 3.

If desired, the arrangement by which the containers 20 are held at their innermost ends may be made even more secure in the manner shown in FIG. 7. In this arrangement, the central hub 46 attached to the backing plate 45 carries a circular plate 60 at its front end that rotates around axle 14 along with the hub. This plate 60 overlaps and retains the innermost edges of the front faces 21 of the containers 20 and thus helps to hold the containers firmly in place. Central circular plate 15 made of transparent acrylic material is mounted on a smaller metal plate 58 screwed to the end of hub 14 and this slidably bears against another circular metal plate 59 secured to plate 60 at the front. A further metal plate 63 conceals the mounting plates 58 and 59 from view. A decorative central ball 64 screws into the central bore 65 in the hub 14. The edges of the circular plate 15 are stabilized by brackets 61 extending inwardly and gently bearing against the front walls 21 of the containers 20 via friction-reducing felt pads 62.

In this way, the containers 20 are securely held in the display unit 11 and the unit is securely mounted for rotation on the support 12.

The support 12 itself comprises a pair of inwardly sloping frame members 55 held in position by cross braces 56 welded in position between the sloping frame members and attached to the base 13 or provided with a supporting foot 57 (see FIG. 6).

The preferred device indicated above can be modified in various ways without departing from the concept underlying the present invention. For example, the recess 40 in the central plate 15 can be made to extend by a greater distance around the periphery of the plate so that the dispensing position may encompass more than one container. Furthermore, the backing plate 45 could be replaced by a number of radial arms or a transparent disc to make the contents of the containers 20 visible from the rear of the device 10, etc.

Moreover, while the front wall of the container has been described as generally transparent, it could be opaque, if desired, and the contents indicated by a label or in some other way, although this would eliminate much of the visual appeal of the device.

We claim:

1. A display and dispenser device for piece goods, comprising:

a plurality of containers for said goods, each container having a container wall including a generally transparent front wall provided with an access opening and a movable door closing said opening, said containers being arranged around a generally horizontal axis to form a display unit, a support for said display unit permitting rotation of said unit about said axis, and means to prevent opening of said door on each of said containers, except for said door on one or more containers in a predetermined position around said axis.

2. A device according to claim 1 wherein said doors open outwardly and said means for preventing opening of said doors comprises a non-rotating plate partially outwardly overlapping said front walls of said containers, including parts of said doors, except for said one or more containers in said predetermined position around said axis.

3. A device according to claim 2 wherein said display unit is rotatably mounted on an axle supported by a support, and wherein said non-rotating plate is carried by said axle at a centre of said display unit.

4. A device according to claim 3 wherein an outer periphery of said non-rotating plate has an inwardly extending recess adjacent to said predetermined position, said recess permitting said doors on said containers in said predetermined positions to open.

5. A device according to claim 1 wherein said access openings in said front walls of said containers are positioned closer to said axis than to outer peripheries of said containers, and wherein said predetermined position where said doors may be opened is at a lowermost point around said axis.

6. A device according to claim 1 wherein said containers have the shape of truncated triangular prisms which together form segments of said circular display unit.

7. A device according to claim 6 wherein said display unit further comprises a central hub rotatable about said axis, a generally circular backing plate rotatable about said axis with said hub, a plurality of anchor blocks spaced around a periphery of said backing plate, a retaining ring carried by said anchor blocks, and sets of spokes extending radially from said hub to said anchor blocks, said containers being positioned between adjacent sets of spokes and retained by said backing plate, said sets of spokes, said anchor blocks and said retaining ring.

8. A device according to claim 7 wherein said backing plate has a reflective surface facing said containers.

9. A device according to claim 1 wherein said doors are retainable in a closed position by catches.

10. A device according to claim 1 wherein said doors have handles to assist opening of said doors when in said predetermined positions.

11. A display and dispenser device for piece goods, comprising:

a plurality of containers for said goods, each container having a container wall including a front wall provided with an access opening and a movable door closing said opening, said containers being arranged around a generally horizontal axis to form a display unit, a support for said display unit permitting rotation of said unit about said axis, and means to prevent opening of said door on each of said containers, except for said door on one or more containers in a predetermined position around said axis.

* * * * *